US009975691B2

(12) United States Patent
Maurice et al.

(10) Patent No.: US 9,975,691 B2
(45) Date of Patent: May 22, 2018

(54) TUBE HEAD FOR PROTECTING AN INSERT FORMING A BARRIER

(71) Applicant: ALBEA SERVICES, Gennevilliers (FR)

(72) Inventors: Thierry Maurice, Chalons en Champagne (FR); Eric Kerman, Chalons en Champagne (FR); Etienne Hermant, Chalons en Champagne (FR)

(73) Assignee: ALBEA SERVICES, Gennevilliers (FR)

( * ) Notice: Subject to any disclaimer, the term of this patent is extended or adjusted under 35 U.S.C. 154(b) by 0 days. days.

(21) Appl. No.: 14/423,806

(22) PCT Filed: Jul. 26, 2013

(86) PCT No.: PCT/EP2013/065856
§ 371 (c)(1),
(2) Date: Feb. 25, 2015

(87) PCT Pub. No.: WO2014/032878
PCT Pub. Date: Mar. 6, 2014

(65) Prior Publication Data

US 2015/0321829 A1 Nov. 12, 2015

(30) Foreign Application Priority Data

Aug. 28, 2012 (FR) ..... 12 58055

(51) Int. Cl.
*B65D 83/28* (2006.01)
*B65D 1/02* (2006.01)
(Continued)

(52) U.S. Cl.
CPC ..... *B65D 83/28* (2013.01); *B65D 1/023* (2013.01); *B65D 35/10* (2013.01); *B65D 35/12* (2013.01)

(58) Field of Classification Search
USPC ..... 220/645
See application file for complete search history.

(56) References Cited

U.S. PATENT DOCUMENTS 3,565,293 A 2/1971 Schultz
4,021,524 A 5/1977 Grimsley
(Continued)

FOREIGN PATENT DOCUMENTS

FR 2320870 A1 3/1977
GB 2098917 A 12/1982
(Continued)

OTHER PUBLICATIONS

International Search Report dated Oct. 25, 2013 (PCT/EP2013/073289); ISA/EP (with English translation).
Written Opinion dated Oct. 25, 2013 (PCT/EP2013/073289); ISA/EP.

*Primary Examiner* — James N Smalley
*Assistant Examiner* — Madison L Poos
(74) *Attorney, Agent, or Firm* — Banner & Witcoff, Ltd.

(57) ABSTRACT

The present invention relates to a plastic tube head for a product having a liquid to pasty consistency, comprising: a neck, a shoulder, an insert forming a barrier which is arranged on the inner surface of the shoulder, said insert comprising at least one metal layer and having an outer edge, the outer edge of the insert and a portion of the face of the insert which is oriented towards the internal volume of the tube and is adjacent to said outer edge being covered by an outer support, characterized in that said outer support has a thickness H and covers a length L of the face of the insert face which is oriented towards the internal volume of the tube, said thickness H and said length L being such that H≥L.

9 Claims, 7 Drawing Sheets

(51) Int. Cl.
*B65D 35/10* (2006.01)
*B65D 35/12* (2006.01)

(56) References Cited

U.S. PATENT DOCUMENTS 4,664,284 A * 5/1987 Magerle ..... B29C 70/845
220/613
5,656,346 A * 8/1997 Hirt ..... B65D 35/08
206/277

FOREIGN PATENT DOCUMENTS

JP 2010083546 A 4/2010
JP 2010083549 A 4/2010

* cited by examiner

TUBE HEAD FOR PROTECTING AN INSERT FORMING A BARRIER

CROSS-REFERENCE TO RELATED APPLICATIONS

The present application is a U.S. National Phase filing of International Application No. PCT/EP2013/065856, filed on Jul. 26, 2013, designating the United States of America and claiming priority to French Patent Application No. 1258055 filed Aug. 28, 2012. The present application claims priority to and the benefit of all the above-identified applications, which are all incorporated by reference herein in their entireties.

GENERAL TECHNICAL FIELD

The present invention relates to tubes for storing and distributing products which are typically in paste, liquid or gel form. It is particularly applicable to cosmetic products.

PRIOR ART

Flexible tubes are very frequently used for distributing liquids, pastes and gels. In many applications, various types of plastics materials are used to manufacture tubes.

A recurring problem with plastics tubes is that they do not make it possible for certain gases and liquids to be prevented from penetrating into the tube, thereby altering the contents of the tube, or, on the contrary, they do not allow certain components of the contents of the tube to be prevented from leaking out, thereby leading to the product itself being degraded.

In order to solve this problem, it has been proposed to provide obstacles, in particular in the region of the tube head, to prevent undesirable components from entering and exiting through the tube head.

An insert, which is also known as a washer, is thus conventionally incorporated into the tube head in order to form a protective barrier, the tube head being formed by plastics injection moulding.

This insert typically comprises a metal layer, which makes it possible to achieve this barrier effect.

However, this solution of adding an insert presents another problem arising from the insert itself. It has in fact been noted that certain products which may be contained in tubes corrode the metal insert, in particular at the edges thereof.

This corrosion may contaminate the contents of the tube, alter the capacity of the tube to protect the product and render it unsightly, and this is problematic in particular in the field of cosmetic products, in which the appearance of the product plays an important role.

Several solutions have been proposed for protecting the insert, and in particular the edges thereof, against the risk of corrosion, for example by covering said edges with the material which forms the tube head.

However, during injection of the plastics material forming the tube head, the insert is deformed, in particular at the ends thereof, thereby having an impact on the covering and thus possibly leading to inserts which have exposed ends, and therefore meaning that the problem of corrosion of the metal layer of the insert resurfaces.

DESCRIPTION OF THE INVENTION

The present invention aims to propose a tube-head structure which does not have such drawbacks, as well as a method for manufacturing such a tube head.

For this purpose, the present invention proposes a tube head for a product having a liquid to pasty consistency, said tube head being produced from plastics material and being capable of being connected to a skirt so as to form a tube having an internal volume, and comprising

- a neck having, at a first end, an opening through which a product is removed from the tube,
- a shoulder connected to a second end of the neck opposite the first end,
- an insert forming a barrier which is arranged on the inner surface of the shoulder, said insert comprising at least one metal layer and having an outer edge which defines a periphery of the insert and is covered in a continuous manner by the plastics material forming the tube head, in which tube head the outer edge of the insert and a portion of the face of the insert which is oriented towards the internal volume of the tube and is adjacent to said outer edge are covered over all or part of the periphery of the insert by an outer support which is made of the plastics material forming the tube head, characterised in that said outer support has a thickness H and covers a length L of the face of the insert which is oriented towards the internal volume of the tube, said thickness H and said length L being such that $H \geq L$.

In a variant, said insert is in the shape of a truncated cone, which converges from the outer edge towards the centre thereof.

Advantageously, the thickness H and the length L are such that $H \geq L+0.1$ mm, or for example such that $H>L$.

According to a particular embodiment, the insert has an inner hole which is aligned with the neck and defines an inner edge.

In such an embodiment, the inner edge of the insert and a portion of the face of the insert which is oriented towards the internal volume of the tube and is adjacent to said inner edge may be covered by an inner support, said inner support having a thickness Hi and covering a length Li of the face of insert which is oriented towards the internal volume of the tube, said thickness Hi and said length Li being such that $Hi \geq Li$.

The thickness Hi and the length Li are thus typically such that $Hi \geq Li+0.1$ mm.

According to another embodiment, said insert comprises at least three superposed layers, these being an upper layer made of plastics material, an inner metal layer, and a lower layer made of plastics material.

The invention also relates to a tube for a product having a liquid to pasty consistency, comprising a tube head as defined above.

DESCRIPTION OF THE DRAWINGS

Other features, aims and advantages of the invention will become clearer from the following description which is given purely by way of illustrative and non-limiting example and should be read with reference to the accompanying drawings, in which.

In all the drawings, identical elements are provided with identical reference numerals.

DETAILED DESCRIPTION

Figure 1:
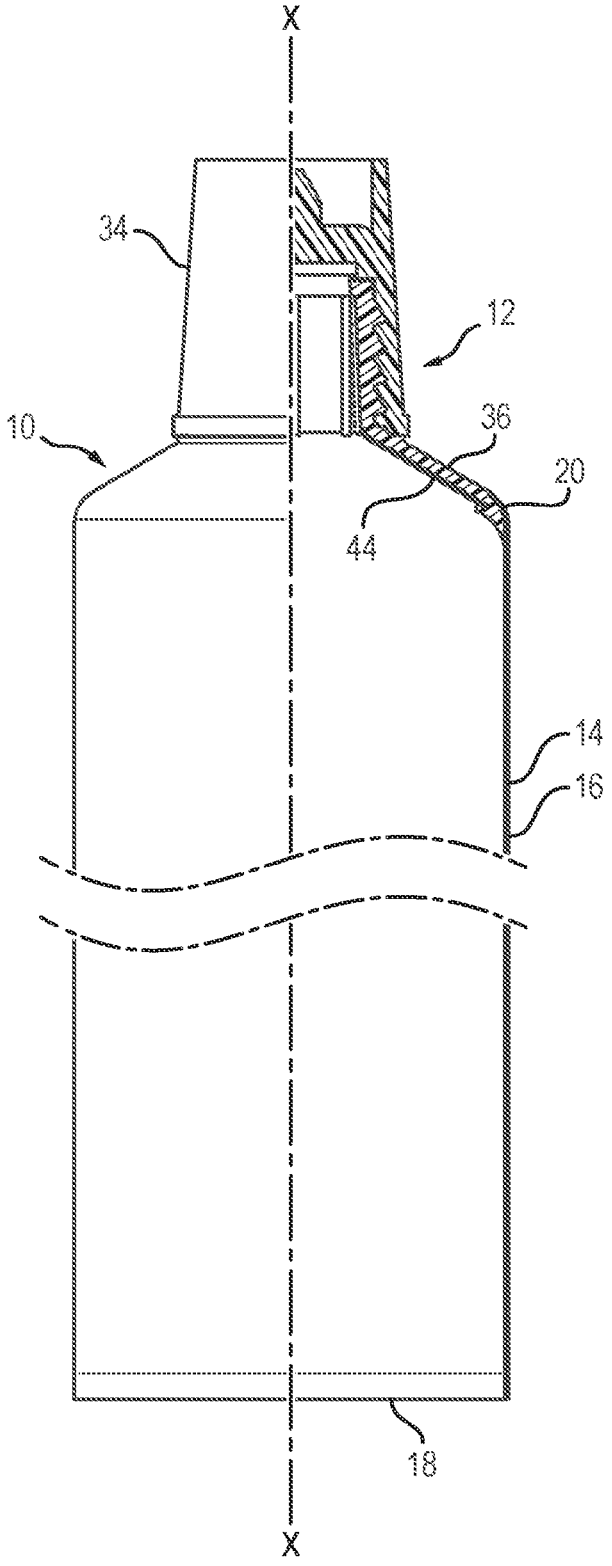
FIG. 1 is a partial cross section through a tube according to an aspect of the invention.
Figure 2:
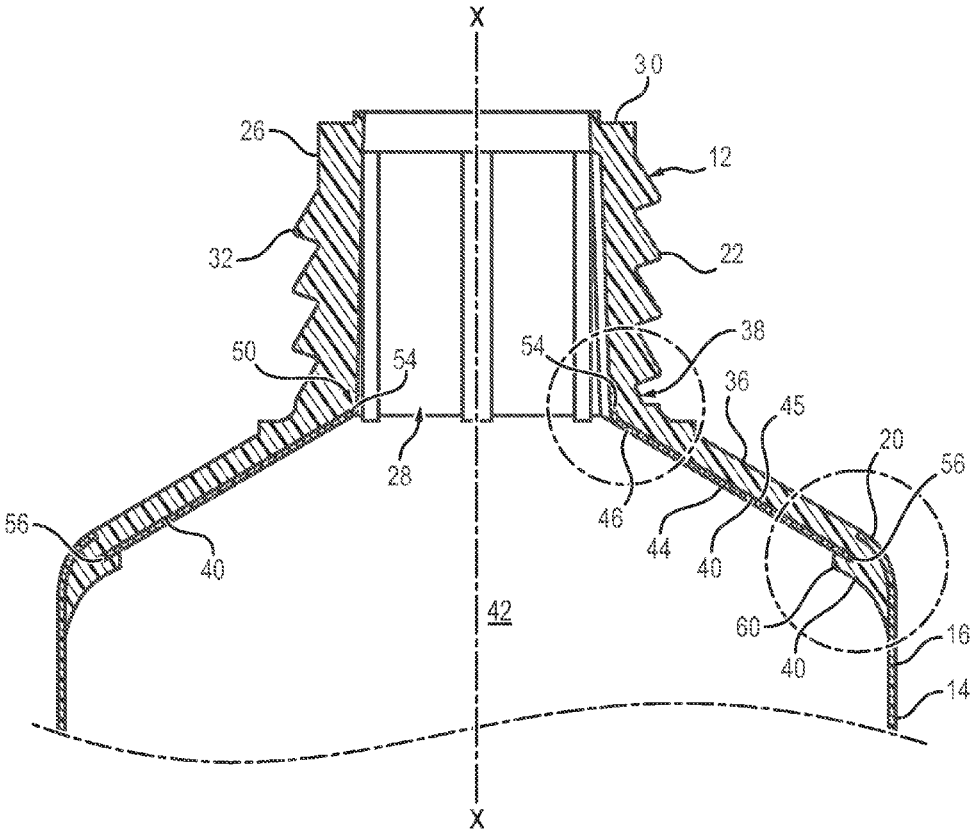
FIG. 2 is a cross section through the head of the tube shown in FIG. 1, FIGS. 3 and 4 are details of portions of FIG. 2.
Figure 3:
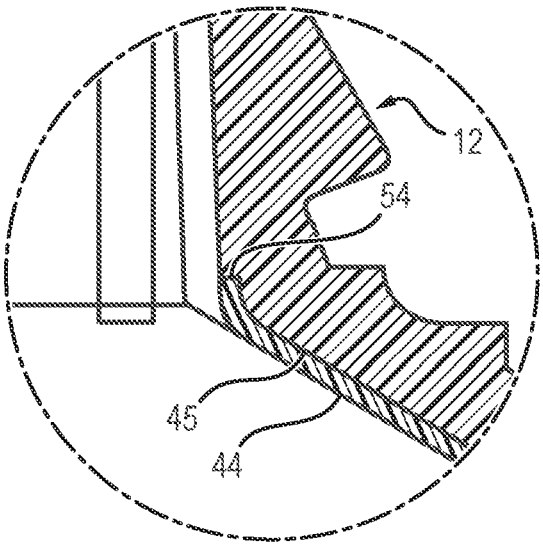
Figure 4:
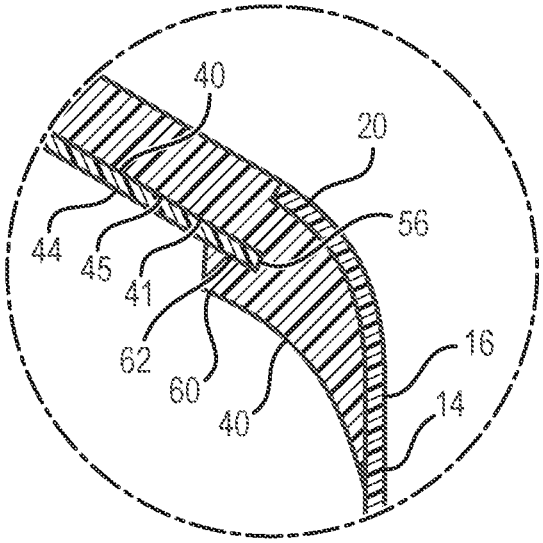

FIGS. 1 to 5 are several views of a tube 10 and of a tube head 12 according to an aspect of the invention.

The tube 10 comprises a tube head 12 connected to a skirt 14 forming a tubular body 16, which is connected to the head 12 at a first end 20 and closed at a second end 18 opposite the first end 20.

The tube head 12 comprises a body 22 made of plastics material having a neck 26 which has an inner passage 28 and opens out at a free end 30.

The neck 26 has an external thread 32 so as to cooperate with a cap 34 comprising a complementary internal thread for closing the tube 10, and defines a longitudinal direction X-X of the tube 10.

A shoulder 36 extends from an end 38 of the neck 26 opposite the free end 30 thereof, the neck 26 and the shoulder 36 being formed in one piece.

The shoulder 36 defines an inner surface 40 which is directed towards the internal volume 42 of the tube 10.

The tube head 12 is connected to the skirt 14, typically by overmoulding the tube head 12 on the skirt 14, or for example by welding or bonding, by mounting the skirt 14 on the previously formed tube head 12, in particular by injection moulding or by compression injection moulding, or by any other method.

The skirt 14 is typically made of plastics material and/or laminated metal; for example a multi-layer assembly comprising one or more layers of metal material such as aluminium, and one or more plastics layers, such compositions being well known to a person skilled in the art.

The tube head 12 further comprises an insert 44, which covers a portion 45 of an inner surface 40 of the shoulder 36.

The insert 44 comprises a metal layer 100, for example an aluminium layer, which is advantageously arranged between two protective layers 101 made of plastics material which cover the two opposite surfaces of the aluminium layer.

The insert 44 as shown is a disc which comprises a central opening 50 and is in the shape of a truncated cone. Upper and lower surfaces are thus defined, as well as an inner edge 54 and an outer edge 56 of the insert 44, between which the insert 44 is substantially linear, with the exception of the inner edge 54, in the region of which the insert 44 is curved so as to fit to the geometry of the tube head and thus follow the curvature of the portion forming the joint between the neck 26 and the shoulder 36 of the tube head 12.

Figure 10:
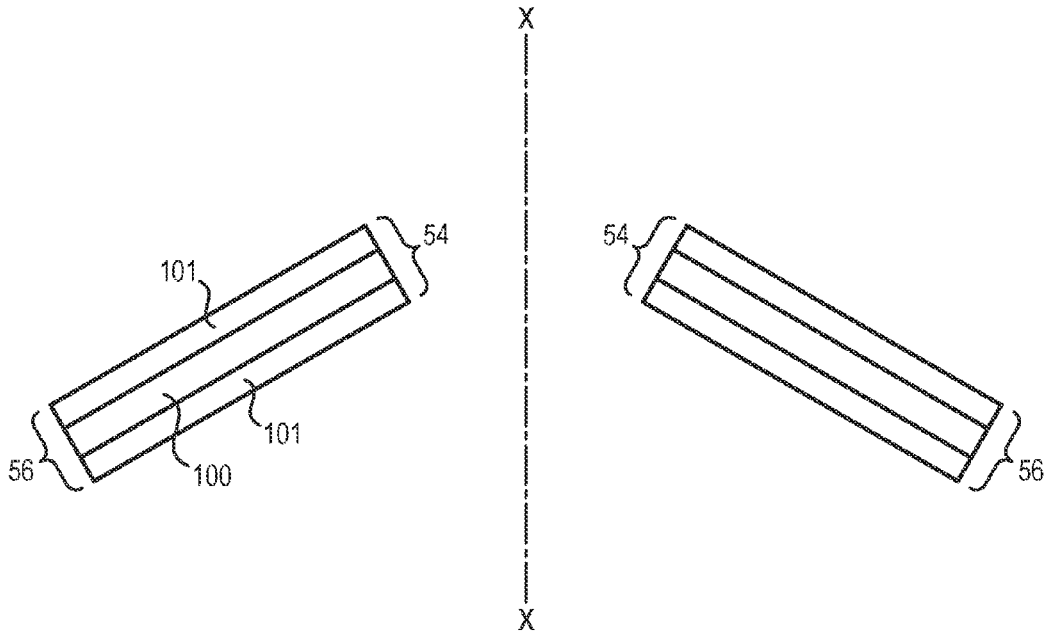
FIG. 10 is a detail of an example of the structure of the insert.

As stated above, said inner edge 54 and outer edge 56 are typically points of weakness of the insert, in that the metal layer 100 forming the insert 44 may be accessible at these points, thereby exposing said layer to corrosion by the product contained in the tube 10 as shown in FIG. 10.

The curvature of the insert 44 in the region of the inner edge 54 thereof allows the part of the insert 44 having the metal intermediate layer 100 to be aligned with the neck 26 of the tube head 12, thus preventing this metal intermediate layer 100 from being directly accessible and thus from being susceptible to corrosion by the product contained in the tube 10.

It is of course understood that the present invention may also apply to an insert 44 which is flat (and therefore not shaped to form a truncated cone) and integrated into a tube head having a substantially planar shoulder, in particular an inner surface 40 which is substantially perpendicular to the longitudinal direction X-X of the tube 10.

As shown in the drawings, the outer edge 56 of the insert 44 is surrounded with plastics material which forms the tube head, in particular via a support 60 which covers the outer edge 56 of the insert 44 and a portion 62 of the outer periphery of the face of the insert 44 which is oriented towards the internal volume 42 of the tube 10.

The support 60 thus forms a shoulder in the region of the outer edge 56 of the insert 44, such that the insert is held between the shoulder 36 of the tube head 12 and the support 60 over a part of its length which is adjacent to its outer edge 56.

Figure 5:
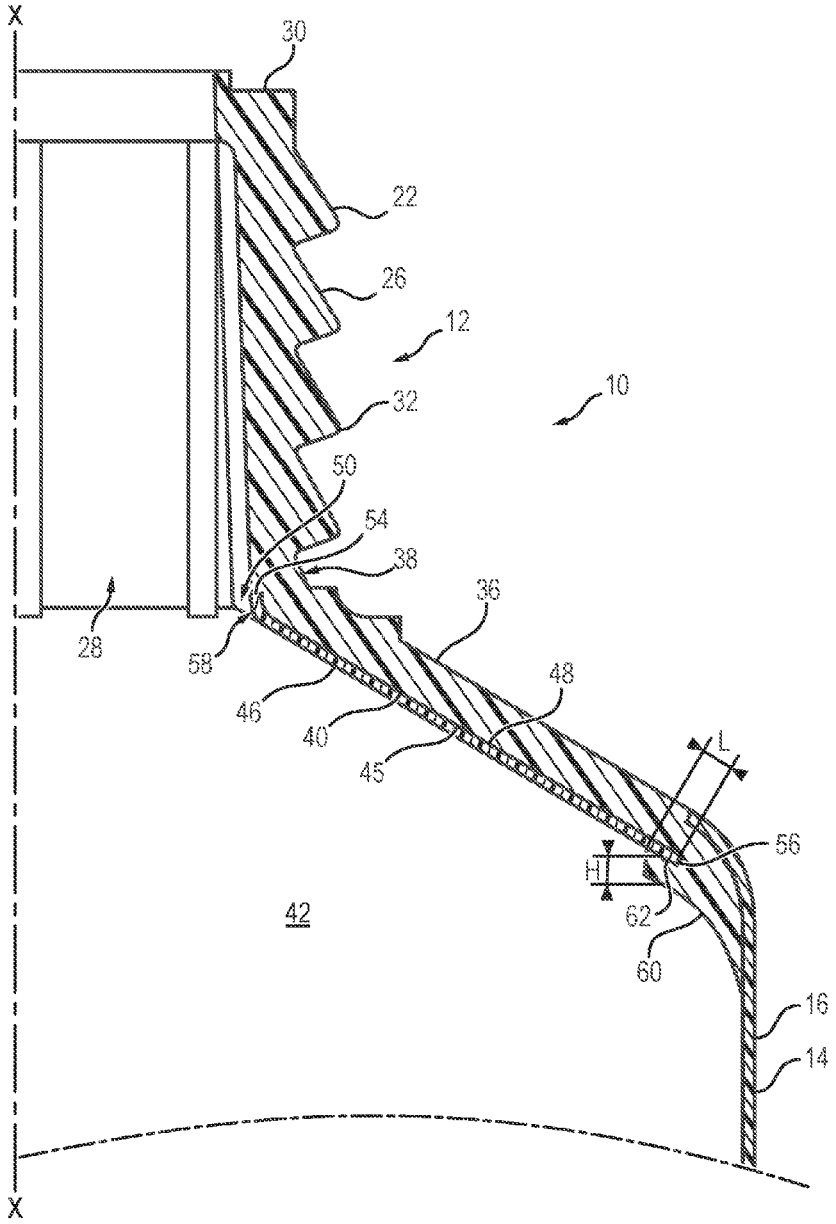
FIG. 5 is a partial cross section through the tube head shown in FIG. 2, FIGS. 6, 7, 8 and 9 show the effect of the dimensioning of the inner and outer supports of a tube head according to an aspect of the invention.

A thickness H of the support 60 and a non-zero length L of the face of the insert which is oriented towards the internal volume 42 of the tube 10 and is covered by the support 60 are thus defined. The length L corresponds to the length of the portion 62 of the outer periphery of the face of the insert which is oriented towards the internal volume 42 of the tube 10 and is covered by the support 60, as shown in FIG. 5.

The thickness H of the support 60 is defined as the average thickness of the support 60, which is measured from the face of the insert 44 which is oriented towards the internal volume 42 of the tube 10 in a direction which is parallel to the longitudinal direction X-X of the tube 10, over the length L of the portion 62 of the outer periphery of the face of the insert which is oriented towards the internal volume 42 of the tube 10 and is covered by the support 60, prior to possible deformation of the insert 44.

This average thickness of the support 60 is thus calculated over the entire length L of the portion 62 of the outer periphery of the face of the insert which is oriented towards the internal volume 42 of the tube 10 and is covered by the support 60, prior to possible deformation of the insert 44.

If the values H and L vary over the periphery of the insert, an average of the thickness H and the length L over the entire periphery of the insert may be taken.

The values for the thickness H and the length L are such that $H \geq L$, typically such that $H \geq L+0.1$ mm, or for example $H>L$, it being understood that these values are given at low cutting tolerances and with variations in the position of the insert 44 relative to the mould, typically relative to a mould die during the injection moulding process.

By way of example, the following pairs of values H, L may be cited:

a) L=0.5 mm, H=0.6 mm;
b) L=1.0 mm, H=1.1 mm;
c) L=0.3 mm, H=0.4 mm;
d) L=0.3 mm, H=0.5 mm;
e) L=0.2 mm; H=0.2 mm;
f) L=1.5 mm, H=1.8 mm.

Dimensioning the support 60 in this way allows it to be ensured that the outer edge 56 of the insert 44 is protected by being covered with the plastics material forming the tube head 12, while preventing or at least compensating the deformation of the insert 44 during injection of the plastics material for forming the tube head 12.

The support 60 is also dimensioned such that the relationship $H \geq L$ is satisfied even if there are imperfections during cutting or centring of the insert 44.

The thickness H is thus dimensioned so as to take into account significant tolerances during cutting of the insert 44.

Furthermore, the thickness H is also dimensioned so as to take into account a possible defect in the centring of the insert 44, for example when the central opening 50 which is made in the insert 44 is off-centre relative to its outer edge forming the outer edge 56 thereof. Since the insert 44 is typically centred on a mould on the basis of its inner edge 54, the outer edge 56 will therefore typically be covered by the support 60 in a partial and non-uniform manner, the length L covered by the support 60 varying according to the point in question on the periphery of the insert 44, it being possible for certain points to be such that the length L covered by the support 60 is zero. The support 60 is thus dimensioned such that, for each point on the periphery of the insert 44, which periphery is defined by the outer edge 56 thereof, at which the length L covered by the support 60 is not zero, the relationship H≥L is satisfied, for example H>L. The invention covers all configurations in which the relationship H≥L, for example H>L, is satisfied at any point on the periphery of the insert. Advantageously, this relationship H≥L, for example H>L, is satisfied over the entire periphery of the insert, whether this be locally or on average.

The invention may also be applicable to the inner edge 54 of the insert 44 when it is straight, and not curved as in FIGS. 1, 2, 3 and 5.

The tube head thus advantageously comprises an inner support 132 which is similar to the outer support 60 set out above and covers the inner edge 54 with plastics material, as well as a portion of the face of the insert which is oriented towards the internal volume 42 of the tube 10 and is adjacent to the inner edge 54.

In the same way as the outer support 60 set out above, for the inner support 132, a thickness Hi and a length Li of the face of the insert which is oriented towards the internal volume 42 of the tube 10 covered by said outer support are defined, the thickness Hi and the length Li being such that Hi≥Li, typically such that Hi≥Li+0.1 mm or for example Hi>Li, it being understood that these values are given at low cutting tolerances.

Figure 6:
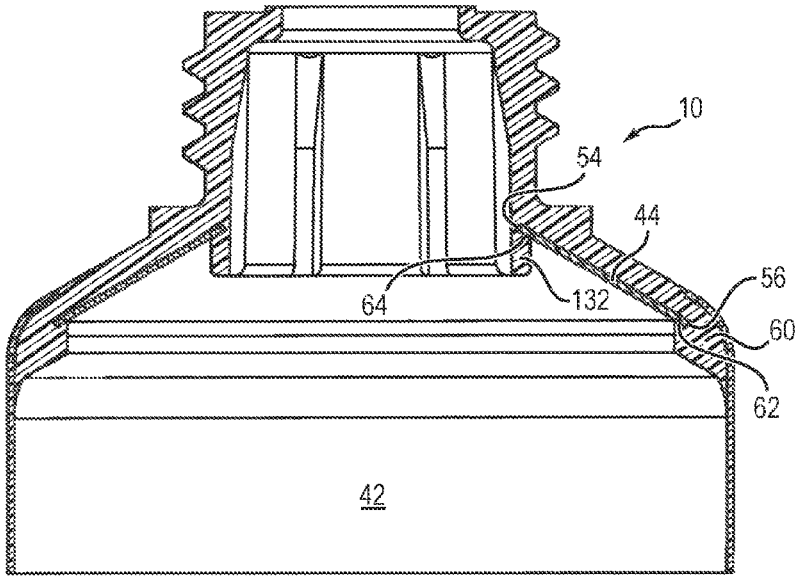
Figure 7:
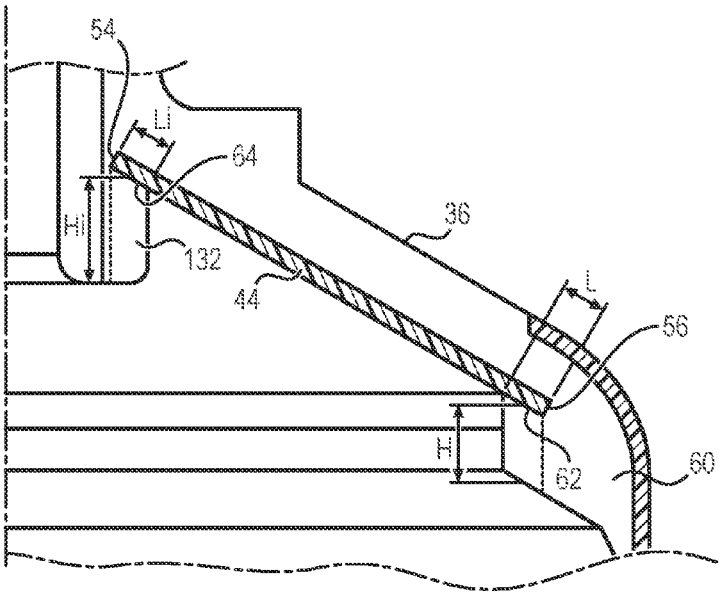

As shown in FIGS. 6 and 7, the inner edge 54 of the insert 44 is thus surrounded by the plastics material forming the tube head via the inner support 132 which covers the inner edge 54 of the insert 44 and a portion 64 of the inner periphery of the face of the insert 44 which is oriented towards the internal volume 42 of the tube 10.

The thickness Hi is defined in a similar manner to the thickness H defined above, as the average thickness of the inner support, which is measured from the face of the insert 44 which is oriented towards the internal volume 42 of the tube 10 in a direction which is parallel to the longitudinal direction X-X of the tube 10, over the length Li of the face of the insert 44 which is oriented towards the internal volume 42 of the tube 10 and is covered by the inner support, prior to possible deformation of the insert 44.

This average thickness of the inner support 132 is thus calculated over the entire length Li of the portion 64 of the inner periphery of the face of the insert 44 which is oriented towards the internal volume 42 of the tube 10 and is covered by the inner support 132, prior to possible deformation of the insert 44.

If the values Hi and Li vary over the periphery of the inner edge of the insert, an average of the thickness Hi and the length Li over the entire periphery of the inner edge of the insert may be taken.

The invention covers all configurations in which the relationship Hi≥Li, for example Hi>Li, is satisfied at any point on the periphery of the inner edge of the insert. Advantageously, this relationship Hi≥Li, for example Hi>Li, is satisfied over the entire periphery of the inner edge of the insert, whether this be locally or on average.

In the same way as for the outer edge 56, dimensioning the inner support in this way makes it possible to compensate the deformation of the insert at the ends thereof during injection of the plastics material forming the tube head 12, and thus to ensure that the inner edge 54 of the insert 44 is well protected from the product contained in the tube 10. Dimensioning the inner support 132 makes it possible to ensure that the inner edge 56 is covered with and protected by the injected plastics material, whatever the degree of deflection of the length Li during injection of the tube head 12.

FIGS. 6, 7, 8 and 9 show the effect of the dimensioning of the inner and outer supports of a tube head according to an aspect of the invention.

FIG. 6 is a cross section through a tube head according to an aspect of the invention, comprising an outer support 60 as set out above and an inner support 132 which covers the inner edge 54 with plastics material, as well as a portion of the face of the insert which is oriented towards the internal volume 42 of the tube 10 and is adjacent to the outer edge 54, said inner support 132 also being dimensioned such that the thickness Hi thereof and the length Li thereof from the face of the insert which is oriented towards the internal volume 42 of the tube 10 and is covered by said outer support are such that Hi≥Li.

FIG. 7 is a detail of said two inner 132 and outer 60 supports, and shows the associated values H, Hi, L and Li.

Figure 8:
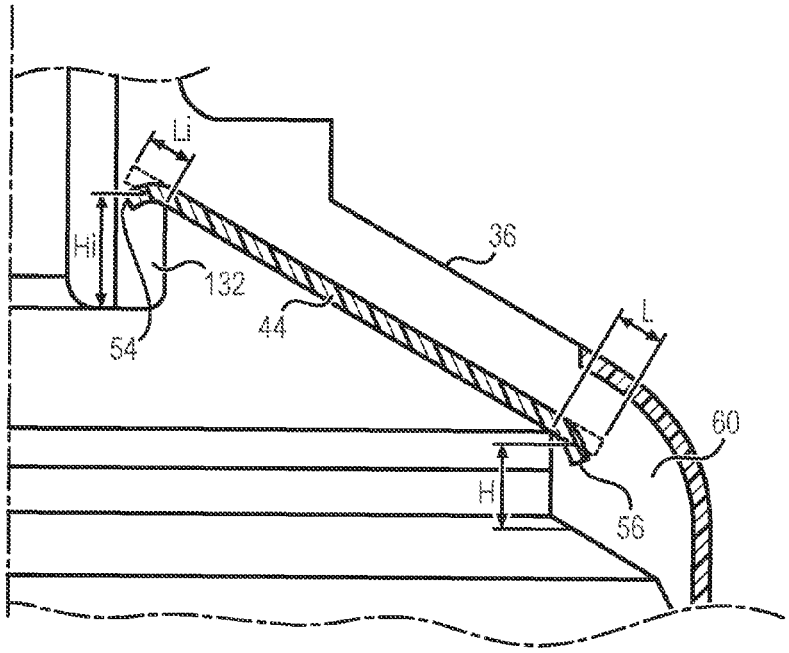
Figure 9:
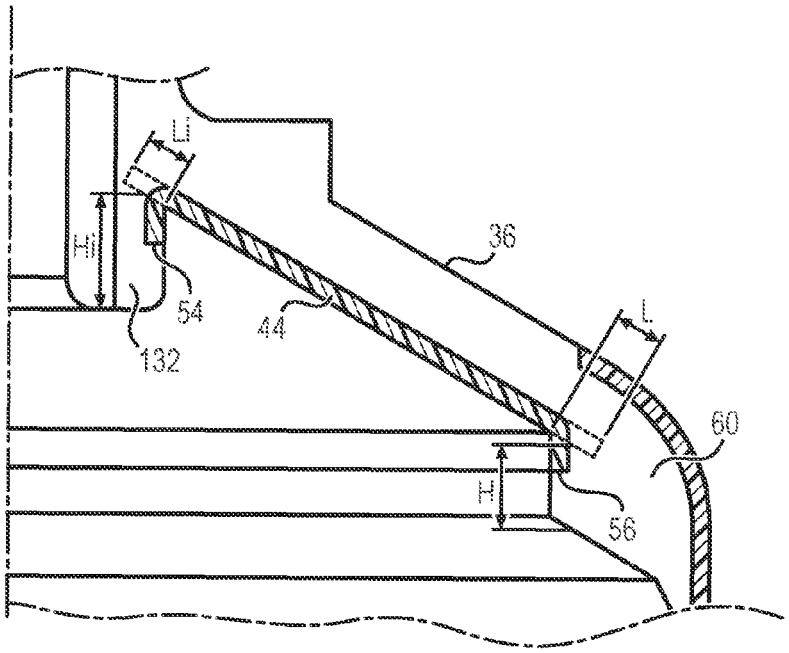

FIGS. 8 and 9 show the effect of said supports 132 and 60 in the event of deformation of the insert, for example during injection of the material forming the tube head, in this case said effect being a deflection at the inner edge 54 thereof and the outer edge 56 thereof.

FIG. 8 shows moderate deflection of the two edges 54 and 56 of the insert 44; it can clearly be seen in said figure that the relationship H>L and Hi>Li ensures that said edges remain covered with plastics material.

FIG. 9 shows the maximum possible deflection of the two edges 54 and 56 of the insert 44 that allows said edges to remain covered with plastics material owing to the supports 60 and 136.

The invention therefore makes it possible to ensure that the inner and/or outer edges 54 and/or 56 are covered by proposing one or more supports 132 and/or 60 which allow the deflection of the edges of the insert 44 to be compensated and the insert 44 to be protected against the risk of corrosion.

The invention claimed is:

1. Tube head for a product having a liquid to pasty consistency, said tube head being produced from plastics material and being capable of being connected to a skirt so as to form a tube having an internal volume, and comprising a neck having, at a first end, an opening through which the product is removed from the tube, a shoulder connected to a second end of the neck opposite the first end, an insert forming a barrier which is arranged on the inner surface of the shoulder, said insert comprising at least one metal layer and having an outer edge which defines a periphery of the insert and is covered in a continuous manner by the plastics material forming the tube head, in which tube head the outer edge of the insert and a portion of a face of the insert which is oriented towards the internal volume of the tube and is adjacent to said outer edge are covered over all or part of the periphery of the insert by an outer support which is made of the plastics material forming the tube head, characterised in that said outer support has a thickness H and covers a length L of the face of the insert which is oriented towards the internal volume of the tube, the thickness H and the length L being such that H≥L, and said insert has an inner hole aligned with the neck and defines a straight inner edge, the inner edge of the insert and an inner portion of the face of the insert which is oriented towards the internal volume of the tube in a direction which is parallel to the longitudinal direction of the tube and which is adjacent to said inner edge are covered by an inner support in a direction which is parallel to the longitudinal direction of the tube.

2. Tube head according to claim 1, wherein said insert is in the shape of a truncated cone, which converges from the outer edge towards a centre thereof.

3. Tube head according to claim 1, wherein the thickness H and the length L are such that $H \geq L+0.1$ mm.

4. Tube head according to claim 1 wherein said inner support has a thickness Hi and covering a length Li of the face of the insert which is oriented towards the internal volume of the tube, said thickness Hi and said length Li being such that $Hi \geq Li$.

5. Tube head according to claim 4, wherein the thickness Hi and the length Li are such that $Hi \geq Li+0.1$ mm.

6. Tube head according to claim 4, wherein the thickness Hi and the length Li are such that $Hi \geq Li$.

7. Tube head according to claim 1, wherein said insert comprises at least three superposed layers, these being an upper layer made of plastics material, an inner metal layer, and a lower layer made of plastics material respectively.

8. Tube for a product having a liquid to pasty consistency, comprising a tube head according to claim 1.

9. Tube head according to claim 2, wherein the thickness H and the length L are such that $H \geq L+0.1$ mm.

* * * * *